United States Patent [19]

Marvosh

[11] Patent Number: 4,763,311

[45] Date of Patent: Aug. 9, 1988

[54] DOUBLE CLOCK FOR DAYLIGHT SAVING

[76] Inventor: Daniel Marvosh, 3085 Clarmeya La., Pasadena, Calif. 91107

[21] Appl. No.: 115,843

[22] Filed: Nov. 2, 1987

[51] Int. Cl.[4] ..... G04B 19/00

[52] U.S. Cl. ..... 368/223; 368/157; 368/228; 368/231

[58] Field of Search ..... 368/223–228, 368/229–231, 157

[56] References Cited

U.S. PATENT DOCUMENTS 2,243,343 5/1941 Johnson ..... 368/228

4,720,820 1/1988 Siefert ..... 368/223

OTHER PUBLICATIONS

Letter to editor Mensa Magazine, date 3/86, "A New Kind of Setting Time, Williams.

*Primary Examiner*—Bernard Roskoski

[57] ABSTRACT

The application discloses two time clocks interconnected by a transmission, one clock is driven by a 60 cycle synchronous motor for standard time which drives the second clock at fast time for six months then slow time for six months.

6 Claims, 1 Drawing Sheet

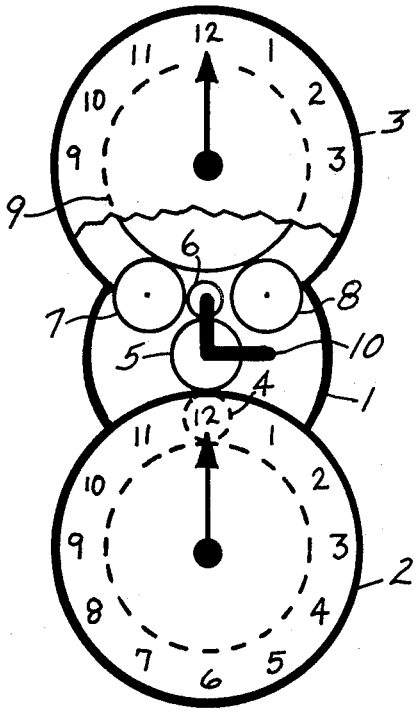
12
1
2
3
4
5
6
7
8
9
10
11
1
2
3
4
5
6
7
8
9
10
11
12
1
2
3
4
5
6
7
8
9
10
11
12
1
2
3
4
5
6
7
8
9
10
11
12

DOUBLE CLOCK FOR DAYLIGHT SAVING

This invention has to do with saving all of the available daylight all year without imposing the two unnatural jet-lag feeling when clocks are changed two times a year.

The present daylight saving is obsolete because the metered time from power generating sources "stands still" relative to the continuously moving earth around its orbit which prevents the maximum utilization of daylight.

One object provides a means to equalize the available daylight to the best advantage every month and provides a choice to save one, two or three hours of daylight progressively all year.

Another object utilizes all present generating systems such as boulder dam and steam operated generators without any changes and are fully compatable with our present time zones and the stars.

A further object provides the freedom to individual business within their local work area to provide all year daylight saving to stagger work periods to smooth out traffic conjestions.

One more object utilizes all 60 cycle electric clocks now in use without any alterations which is the basic and most common precision time piece in the home and office.

The spring wound and quartz time pieces will be designed to be compatable for all year daylight saving.

These and other objects will be apparent from the the drawings and the following description. Referring to the drawings:

BRIEF DESCRIPTION OF THE DRAWINGS

FIG. 1 depicts the Double Clock and

FIG. 2 shows a yearly operational cycle.

FIG. 1

For clarity the minute hand has been omitted on the clock. Transmission housing 1 contains a gear train connecting clocks 2 and 3. Clock 2 is driven by the standard synchronous motor. Gear 4 is driven by the clock 2 motor. Idle gear 5. Shifting gear 6 drives the gear train for clock 3 fast or slow time. Gear 7 is for fast time. Gear 8 is for slow time. The difference in pitch diameter between gears 7 and 8 provides the precise speed for fast or slow time. Gear 9 is the drive gear to operate clock 3. There is no motor in clock 3. The shifting lever 10 pivots on the gear 5 shaft. Shifting two times a year is done automatically by computer, mechanically, Solenoid or other means or any combination thereof. The hour and minute hands on clock 3 locates on the gear 9 shaft to obtain a direct drive for clock 3.

FIG. 2

In operation the clocks 2 and 3 begin at 12 o'clock on December 21. Two months later clock 3 will be one hour fast time at one minute per each 24 hour day. Four months later clock 3 will be two hours fast. Six months later clock 3 will be three hours fast, on the longest day of the year. On June 21 the gear 6 shifts to the slow time gear 8 and continues back to the starting point December 21 when both clocks will be at 12 o'clock ending the one year cycle.

Because of many variables in machinery and temperature variations it is impossible to constantly maintain the ultra accuracy from the stars without adjustments. At the power source the increase or decrease in measured time is periodically monitored and adjustments are made as needed. This is the means to be used at the power source to control the new daylight saving time all year for fast or slow. To save three hours of daylight the continuous changing will be only $2\frac{1}{2}$ seconds per hour which will not effect existing electrical motors. At the power source is the positive way to deliver accurate daylight saving time.

I claim:

1. A double clock for daylight saving, comprising:

(a) a first clock having a clock movement;

(b) a drive means for driving said clock movement of said first clock;

(c) a second clock having a drive movement; '(d) transmission means operatively interconnecting said drive means and said clock movement of said second clock, said transmission means comprising:

(i) a first means for driving said clock movement of said second clock at a first rate of speed;

(ii) a second means for driving said clock movement of second clock at a second rate of speed; and (iii) selector means for selectively interconnecting said first and second means with said drive means.

2. A double clock as defined in claim 1 in which said drive means comprises a synchronous electric motor.

3. A double clock as defined in claim 2 in which said first means of said transmission means drives said clock movement of said second clock at said first rate of speed for a period of one-half a year and in which said second means of said transmission means drives said clock movement of said second clock at a second slower rate of speed for a period of one-half a year.

4. A double clock as defined in claim 3 in which said transmission means comprises:

(a) a first gear operatively connected to said drive means and (b) a shifting gear operatively connected to said first gear said shifting gear being adapted to selectively drive said first and second means.

5. A double clock as defined in claim 4 in which said first means comprises a third gear and said second means comprises a fourth gear, said third gear and fourth gear being selectively drivable by said shifting gear.

6. A double clock as defined in claim 5 in which said transmission means further includes lever means operatively connected to said shifting gear for moving said shifting gear into driving engagement with one of said third and fourth gears.

* * * * *